United States Patent [19]

Wong

[11] Patent Number: 4,764,148

[45] Date of Patent: Aug. 16, 1988

[54] TOY ADAPTED TO CRAWL DOWN A VERTICAL SURFACE

[75] Inventor: Tak-ko Wong, Hong Kong, Hong Kong

[73] Assignee: T. K. Wong & Associates Limited, Hong Kong

[21] Appl. No.: 45,619

[22] Filed: May 1, 1987

[30] Foreign Application Priority Data

Oct. 13, 1986 [GB] United Kingdom ..... 8624494

[51] Int. Cl.[4] ..... A63H 17/00; A63H 11/04

[52] U.S. Cl. ..... 446/431; 446/289

[58] Field of Search ..... 446/431, 433, 445, 465, 446/469, 901, 169, 168, 316, 269, 278, 289, 290, 314, 491; 272/8 N, 8 R

[56] References Cited

U.S. PATENT DOCUMENTS

| | | | |
|---|---|---|---|
| 1,187,660 | 6/1916 | Savage | 446/289 |
| 1,836,640 | 12/1931 | Bowman . | |
| 2,001,013 | 5/1935 | Davis . | |
| 2,839,302 | 6/1958 | Almoslino . | |
| 2,861,390 | 11/1958 | Martin . | |
| 3,494,070 | 2/1970 | Lemelson . | |
| 3,690,393 | 9/1972 | Guy . | |
| 3,810,515 | 5/1974 | Ingro . | |
| 4,373,290 | 2/1983 | Goldfarb et al. | 446/462 X |
| 4,477,998 | 10/1984 | You | 446/433 X |
| 4,571,204 | 2/1986 | Wang . | |

FOREIGN PATENT DOCUMENTS

| | | | |
|---|---|---|---|
| 2052557 | 5/1972 | Fed. Rep. of Germany | 446/462 |
| 55-78982 | 6/1980 | Japan . | |
| 55-78983 | 6/1980 | Japan . | |
| 55-78985 | 6/1980 | Japan . | |
| 696660 | 9/1953 | United Kingdom . | |
| 1402126 | 8/1975 | United Kingdom . | |

*Primary Examiner*—Mickey Yu

*Attorney, Agent, or Firm*—Ostrolenk, Faber, Gerb & Soffen

[57] ABSTRACT

A toy adapted to crawl down a vertical surface has a frame carrying a shell at one end and a roller at the other. The roller has a corrugated surface of soft tacky material such that the roller will roll slowly down a vertical surface.

25 Claims, 1 Drawing Sheet

TOY ADAPTED TO CRAWL DOWN A VERTICAL SURFACE

INTRODUCTION

This invention relates to a toy, and in particular to a toy which will run down a vertical surface.

BACKGROUND

Toys which have the facility to run down vertical surfaces are well known in the toy art.

GB No. 1402126 discloses a toy having a shell and a magnetic roller housed in the shell. The roller adheres to a vertical ferromagnetic surface and the weight of the shell and roller cause the toy to roll downwards, the magnet keeping in touch with the surface. The specification also envisages a roller which may be electrostatically charged by rubbing and so adhere to a surface that way.

GB No. 696660 also shows a falling toy utilising a magnetic roller to attach it to a vertical surface.

U.S. Pat. No. 3,810,515 uses a magnet or a powered fan forming a vacuum to hold the toy against a surface.

GB No. 716949 discloses a toy which uses a plurality of magnets or suction cups which are mounted on spokes of a wheel. A spring or weight causes the wheel to rotate, the suction cups sequentially sticking to and lifting off a surface to effect a walking action. The specification envisages the use of a sticky substance on the ends of the spokes in place of the suction cups.

These toys have the drawback that they are limited to use on ferromagnetic surfaces or that they are complicated and expensive to produce, utilising many parts.

SUMMARY OF THE INVENTION

According to the present invention, there is provided a toy comprising a shell and at least one roller supported by the shell for rotation relative thereto, the outer peripheral surface of the roller being ridged to define a plurality of angularly spaced axially extending crests of sticky material. When placed in contact with a vertical surface the roller will stick to the surface but will roll down the surface due to the weight of the roller, carrying the shell with it.

In another aspect the invention provides a toy comprising a frame, a roller mounted on the frame for rotation about an axis and a shell mounted on the frame, the shell being open at a side thereof, wherein the roller has a circumferential surface formed by a plurality of arcuate crests of sticky material, the crests extending in the axial direction of the roller, whereby the said open side of the shell may be placed against a vertical surface, a first crest of the roller contacting the surface and sticking thereto, the weight of the shell frame and roller causing the roller to roll downwards about the first crest to bring a second crest into sticking contact with the surface and detach the first crest from the surface, and so on.

In another aspect the invention provides a toy comprising a frame having two arms connected between their ends by a cross-bar, a shell loosely mounted on first ends of the arms to one side of the cross bar, a roller rotatably mounted on second ends of the arms on an opposite side of the cross bar to said one side, said roller having a circumferential surface comprising ridges extending substantially parallel to the axis of rotation of the roller, and said ridges being formed of tacky material whereby said toy may be adhered to a vertical surface, said roller rotating under the weight of the toy to bring each of said ridges in turn into sticking contact with the surface such that said toy moves vertically down the surface.

According to yet another aspect the invention provides a toy comprising a shell and a roller mounted within the shell for rotation, the shell defining an opening through which a circumferential surface of the roller projects for contact with a supporting surface, wherein the circumferential surface of the roller is corrugated, the corrugations extending transverse to a direction of rotation of the roller, the corrugations being formed of tacky material, the tackiness of the material being such that where upper and lower corrugations of the circumferential surface are pressed against a vertical surface the upper corrugation is slowly peeled from the surface by the weight of the shell and roller, the roller pivoting on the surface about the lower one of the corrugations to bring a corrugation beneath the lower one into sticking contact with the surface.

DESCRIPTION OF THE PREFERRED EMBODIMENT

Figure 1:
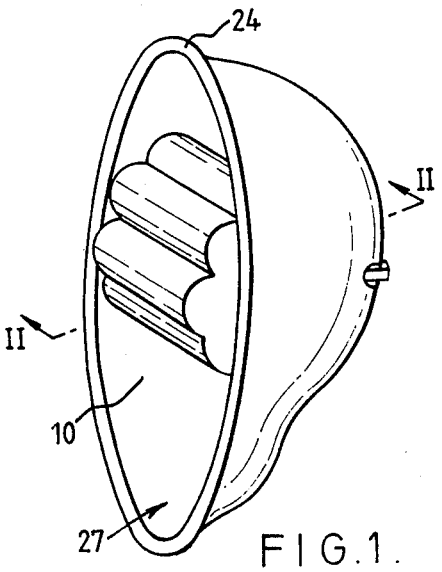
FIG. 1 is a perspective view of one embodiment of a toy according to the invention.

Referring to the drawings, the toy shown therein comprises a shell 10 which can take any appropriate shape such as to simulate an insect, e.g. a beetle, or a toy motor car, and a roller 11 supported inside the shell 10 on an H-shaped frame 12 for rotation.

The shell 10 is vacuum formed from thin plastics material and preferably is decorated according to the desired shape, e.g. to simulate an insect or motor car. The shell has a peripheral flange 24 defining an opening 27.

Figure 2:
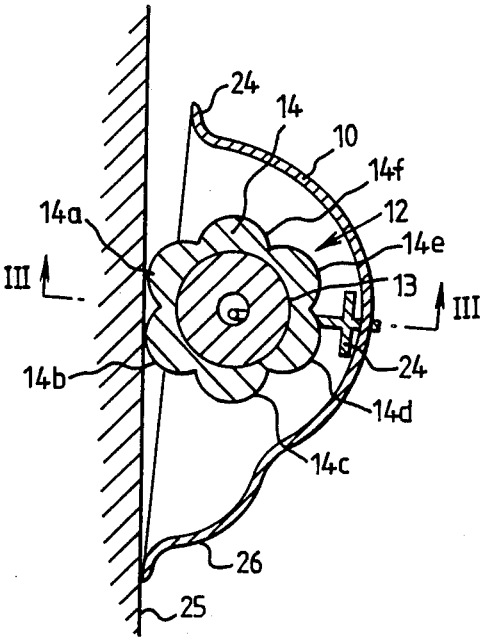
FIG. 2 is a section taken through line II—II of the toy of FIG. 1 and showing the toy in contact with a vertical surface.

The roller 11 comprises a cylindrical former 13 which carries an extruded band 14 of resilient sticky plastic material which is generally cylindrical in shape and has a plurality of axially extending lobes 14*a*–14*f* of half-cylindrical shape, as seen in FIGS. 1 and 2.

The former 13 is integrally moulded from a plastic material and comprises a tubular cylindrical axle 15 having a through bore 16. A flange 17 extends around the circumference of the axle 15. Two pins 18 extend laterally of the flange 17. The band 14 of resilient sticky polymer material is extruded about the former 13 and is held in position axially by the flange 17 and circumferentially by the pins 18.

The constituents of the polymer material of the band 14 are selected to provide a soft or resilient material which will be readily and resiliently deformed by a weight of a few ounces. The material includes a tackifier which imparts a tackiness or stickness to the surface of the material. Such polymer materials and their constituents are well known and it is necessary only to blend suitable constituents to achieve the desired degree of deformability and tackiness according to the weight of the toy. The tackiness is such that dirt adhering to the circumference of the band may be removed by placing a piece of adhesive tape on the circumference of the band and removing it, the tape carrying the dirt with it.

The preferred constituents of the band material are polymerizing styrene, butadiance, napthenic oil, calcium carbonate and hydrogenated polyterpene resin, the latter being the tackifier.

The roller 11 is mounted in the H-shaped frame 12 which will now be described in more detail.

Figure 3:
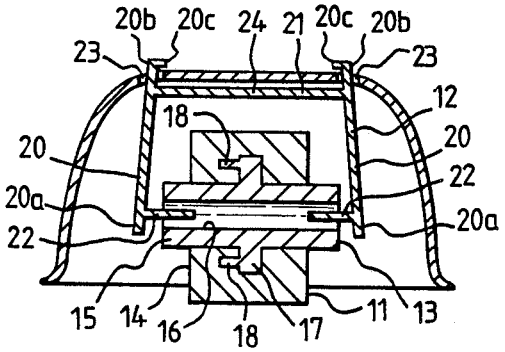
FIG. 3 is a section taken through the line III—III of FIG. 2.

Referring to FIG. 3, the frame 12 comprises two upights 20 connected between their ends by a cross-bar 21.

First ends 20*a* on one side of the cross-bar 21 carry axle supports 22 which project inwardly of the frame. The cylinder 15 of the roller 11 is mounted on the axle supports 22 which project in to the bore 16. The frame 12 is of flexible plastic material allowing the ends 20*a* to be drawn apart for mounting the roller 11 on the ends.

Second ends 20*b* of the H-shape frame 12 on the opposite side of the cross-bar 21 project through apertures 23 in the shell 10. Nibs 20*c* are formed on the ends 20*b* and the shell is trapped between the nibs 20*c* and cross-bar 21, the frame 12 thus being loosely mounted in the shell. A stabiliser 28 extends laterally on each side of the cross-bar 21 (see FIG. 2) and serves to limit the degree of movement of the frame and so keep the roller 11 clear of the inside surface of the shell 10. The frame is mounted in the shell by clipping the nibs 20*c* through the apertures 23, the flexibility of the frame 12 and thin walled shell 10 allowing this.

The roller 11 then is rotatably mounted on one end of the frame 12, the other end being loosely mounted in the shell to swing in the shell by a limited amount.

The toy will attach to and gradually run down a vertical surface in a manner which will now be described. Considering the roller 11 in the position shown in FIG. 2, that is to say with two half-cylindrical lobes 14*a* and 14*b* in contact with vertical surface 25, the moment exerted by the mass of the toy will place lobe 14*a* under tension and lobe 14*b* under compression. Lobe 14*a* will be pulled away from the surface 25 and lobe 14*a* will alone hold the roller on the vertical surface 15 momentarily until lobe 14*c* swings about the area of contact between lobe 14*b* and the wall 25 to come into contact with the surface 25 to reinforce the holding force and prevent the roller falling off the surface 25.

The band 14 is of resilient material. The effect of this is that as lobe 14*c* swings around it hits the wall 25 with some force and so deforms, forming a flat contact area between the lobe 14*c* and the wall. The upper part of the contact area of lobe 14*a* is peeled away gradually, but with somewhat increasing speed, as the roller rotates to detach suddenly from the wall before the lobe 14*c* contacts the wall.

The roller 11 will consequently run down the surface 25 carrying the shell 10 with it, the rate of movement depending upon a number of parameters including the mass of the toy, the degree of stickiness of the lobes 14 and the nature of the surface 25.

The shell 10 pivots on the frame 12 so that its front or lower end 26 bears against the surface 25. The flange 24 serves to prevent the edge of the shell digging into the textured surfaces which would impede the progress of the toy, or cause it to lift off the wall, pivoting about the front end.

The above embodiment is given by way of example only and various modifications may be made without departing from the scope of the invention. For example, the roller may be replaced by two or more rollers or wheels mounted on a common axle, each wheel having a simulated tyre of sticky material. Furthermore, the sticky material need only form the crests and could therefore take the form of discrete elements attached to a former in angularly spaced relationship. The sticky material could, moreover, be in the form of an adhesive coating or layer on a base of resilient plastics material and the plastics material could, for example, be in the form of an injection moulding rather than an extrusion.

What is claimed is:

1. A toy comprising a shell and at least one wheel having a circumferential surface and supported to rotate relative to the shell, and a plurality of lobes angularly spaced and circumferentially and circularly extending around the wheel and projecting axially therefrom, each of the lobes having an arcuate surface with a curvature noticeably greater than that of a national circle enclosing the lobes, each of the lobes being constituted of a body formed of resilient material and the surfaces of the lobes comprising a sticky material.

2. A toy according to claim 1, wherein the lobes are of curved cross-section.

3. A toy according to claim 2, wherein said sticky material is a resilient plastics material containing a tackifier.

4. A toy according to claim 2, wherein said material is a plastic material, and wherein said stricky material is provided by a tacky coating or layer on said resilient plastic material.

5. A toy according to claim 3, wherein said wheel comprises a former, said plurality of lobes are arranged in the form of a band mounted on said former, and the former being supported for rotation relative to said shell.

6. A toy according to claim 5, wherein the resilient plastics material is an extrusion.

7. A toy according to claim 5, wherein the resilient plastics material is an injection molding.

8. A toy comprising a frame, a roller mounted on the frame for rotation about an axis, and a shell mounted on the frame, the shell defining an opening at one side, the roller having a circumferential surface which is constituted of a plurality of lobes angularly spaced and circumferentially and circularly extending around the roller and projecting axially therefrom, each of the lobes having an arcuate surface with a curvature noticeably greater than that of a notional circle enclosing the lobes, each of the lobes being constituted of a body formed of resilient material and the surfaces of the lobes comprising a sticky material.

9. A toy as claimed in claim 8, wherein the circumferential surface is formed by soft polymeric material including a tackifier.

10. A toy as claimed in claim 9, wherein the roller comprises a shaft rotatably mounted on the frame and a band of said soft polymeric material extends circumferentially about the shaft.

11. A toy as claimed in claim 10, wherein the lobes project radially from the band and each lobe is comprised of a respective cylindrical crest extending parallel to the direction of rotation, the surface of the crest subtending an angle of about 180 degrees.

12. A toy as claimed in claim 11, wherein six lobes are provided on the band.

13. A toy as claimed in claim 12, wherein the frame is pivotally mounted at one end in the shell.

14. A toy as claimed in claim 13, wherein the shell has a flange extending about and defining a periphery of the opening.

15. A toy comprising a frame having two arms connected between their ends by a cross-bar, a shell loosely mounted on first ends of the arms to one side of the cross-bar, a roller rotatably mounted on second ends of the arms on an opposite side of the cross-bar to said one side, said roller having a circumferential surface which is comprised of a plurality of lobes angularly spaced and circumferentially and circularly extending around the roller and projecting axially therefrom, each lobe being comprised of a cylindrically shaped section which is formed around an axis which axis extends substantially parallel to the axis of rotation associated with the roller, each of the lobes having an arcuate surface with a curvature noticeably greater than that of a notional circle enclosing the lobes, each of the lobes being constituted of a body formed of resilient material and the surfaces of the lobes comprising a sticky material.

16. A toy as claimed in claim 15, including means for limiting relative swinging movement of the frame and shell.

17. A toy as claimed in claim 16, wherein the frame is H-shaped and wherein the roller comprises an axle mounted on the H-shaped frame, and said plurality of lobes are arranged in the form of a band of said sticky material extending around said axle.

18. A toy as claimed in claim 17, wherein said lobes are of substantially semi-circular cross-section.

19. A toy as claimed in claim 18, wherein said shell is vacuum formed.

20. A toy as claimed in claim 19, wherein said shell has a peripheral flange defining an opening, the lobes of said roller projecting through the opening to make contact with the vertical surface.

21. A toy comprising a shell and at least one wheel having a circumferential surface supported to rotate relative to the shell, a circumferentially extending band of resilient and deformable material extending around the wheel, and a plurality of lobes projecting radially from the band and being formed integrally with and of the material of the band, each of the lobes having an arcuate surface with a curvature greater than that of a notional circle enclosing the lobes and the exterior surfaces of the lobes comprising a sticky material.

22. A toy comprising a shell and a roller mounted within the shell for rotation relative to the shell, the shell defining an opening through which a circumferential surface of the roller projects for contact with a supporting surface, the circumferential surface of the roller comprising a plurality of lobes, each of the lobes having an arcuate surface with a curvature noticeably greater than that of a notional circle enclosing the lobes, each of the lobes extending parallel to an axis of rotation associated with the roller, the lobes being formed of resilient, tacky material, the resilience and tackiness of the material being such that where upper and lower lobes of the circumferential surface are pressed against a vertical surface the upper lobe is slowly resiliently deformed and peeled from the surface by the weight of the shell and roller, the roller pivoting on the surface about the lower one of the lobes to bring a lobe beneath the lower one into sticking contact with the surface, said lower lobe being resiliently deformed as it contacts the surface.

23. A toy as claimed in claim 22, wherein the lobes are dimensioned so that no more than two lobes ordinarily contact the surface at any one time.

24. A toy as claimed in claim 23, wherein the material of the lobes is a soft polymeric material incorporating a tackifier.

25. A toy as claimed in claim 24, wherein the tackifier is a polyterpene resin.

* * * * *